United States Patent [19]

Merrick

[11] Patent Number: 5,005,826

[45] Date of Patent: Apr. 9, 1991

[54] NECK EXERCISER DEVICE AND METHODS

[76] Inventor: John H. Merrick, 1465 Hooksett Rd., Hooksett, N.H. 03102

[21] Appl. No.: 293,745

[22] Filed: Jan. 3, 1989

Related U.S. Application Data

[63] Continuation-in-part of Ser. No. 940,963, Dec. 12, 1986, abandoned.

[51] Int. Cl.[5] ..... A63B 23/025

[52] U.S. Cl. ..... 272/94; 272/130

[58] Field of Search ..... 272/93-96, 272/76, 77, 141, 135, 130; 273/58 B, 58 K; 73/379; 128/25 R

[56] References Cited

U.S. PATENT DOCUMENTS

| | | | |
|---|---|---|---|
| 2,129,763 | 9/1938 | Hart | 73/4 R |
| 2,510,193 | 6/1950 | Pough et al. | 272/96 |
| 3,910,572 | 10/1975 | Denler | 272/68 |
| 4,108,428 | 8/1978 | Winterbottom | 73/379 |
| 4,114,449 | 9/1978 | Dikeman et al. | 73/379 |
| 4,460,171 | 7/1984 | Plyhm | 272/94 |
| 4,530,496 | 7/1985 | Smith et al. | 272/130 X |

*Primary Examiner*—Robert Bahr

*Attorney, Agent, or Firm*—Lee A. Strimbeck

[57] ABSTRACT

A cervical dynamometer and exerciser providing variable isokinetic resistance in all directions of motion comprises an inflated hollow ball having a flexible non-extensible skin, a handle attached thereto, and a gauge for observing and a hand pump for adjusting the pressure in the ball.

7 Claims, 1 Drawing Sheet

NECK EXERCISER DEVICE AND METHODS

RELATED APPLICATION

This application is a continuation-in-part of U.S. patent application Ser. No. 06/940 963, filed Dec. 12, 1986, abandoned 9/7/88 by the same inventor and have the same title.

This invention pertains to an exercise device and is particularly concerned with one providing feedback to exercise, evaluate and rehabilitate the muscles of the cervical spine safely and efficiently.

BACKGROUND OF INVENTION

There has been a desideratum for an effective device and associated program for the rehabilitative exercising of the muscles of the neck, especially in a manner that can provide different, adjustable levels of exercise. People often strain or otherwise injure the muscles of the neck and subjacent joints. This is particularly true of those who engage in hard contact sports such as football and wrestling. Also, whiplash injuries stemming from automobile accidents are quite common. To speed the recovery, it is desirable for the people so injured to exercise the neck muscles in all planes of movement in a manner that allows for a graduated increase in the strenuousness of the exercise in order to speed recovery. The present invention fulfills this need.

Whiplash and athletic injuries can result in joint instablity as well as muscle insult. During the course of rehabilitation it is important to correct both the biomechanical aberrancies as well as to rehabilitate the musculature involved. While mechanical correction is performed through the use of spinal manipulative therapy, muscle correction should be performed by therepeutic exercises. There are several ways in which the muscles can be strengthened following an incident and/or as a preventative measure as well. Such ways include weights, various isotonic methods with the utilization of harness and chain, plate weights on the front and back of the head, or the various neck machines available in health clubs. Machines usually allow movement of the head in only one or two planes of motion. Isometrics can also be done using one's hands.

Since the action of the gross muscles of the neck include flexion, rotation and lateral bending (sternocleidomastoid), it would seem appropriate to exercise these muscles in a functional type of method. The present invention provides this type of exercise. There is also available positive feedback in terms of amounts of strength expended in the various planes of motion. With the utilization of the modality of the present invention, a graduated program can be instituted.

It is well established that muscle training proceeds safely and efficiently when exercise occurs at some predetermined fraction of an individual's maximum strength. The applicability of this principle to the treatment of cervical spinal injuries, however, has been hampered by the lack of an easy and inexpensive method of providing feedback related to the forces generated by the muscles of the cervical spine. The present device provides such feedback. It is a self inflating flexible sphere against which the head can be placed to push it against a wall, which sphere has a handle and means to observe and adjust the internal pressure so that the forces generated by the muscles of the cervical spine during exercise can be observed and controlled or graduated as required for a variety of exercises.

THIS INVENTION

This invention is a neck muscle dynamometer and exerciser providing variable isokinetic resistance in all directions of motion comprising:

- a resilient inflated ball having a flexible skin of an elastomer; and
- a cylindrical handle attached to the skin perpendicular to the surface of the ball.

The inflated device preferably has a diameter in the range of 8 to 12 inches and is inflated to a pressure in the range of preferably 4 to 8 pounds per square inch.

The device also preferably includes a means permitting the observing and adjusting of the internal pressure of the ball and thus of the hardness of resistance offered by the ball.

The method of exercising of the neck using the ball comprises holding the ball against a substantially vertical wall or surface by means of the handle and placing the head against the ball and pressing the ball against the surface. Thereafter, while holding the ball against the surface with the head, the head is rotated in all directions of motion to exercise the neck muscles.

The strenuousness of the exercise is determined by how hard one pushes his head against the ball and by the internal pressure within the ball. The exerciser gets as much out as he puts into it. The internal pressure can be adjusted from time to time to change the resistance offered by the ball.

Preferably, a pressure gauge is used to determined the pressure within the ball as one is using it so that one may judge or determine the amount of effort being exerted in one exercise period relative to the effort exerted in another exercise period. This permits the user to assess the relative strength, power and endurance of the neck muscles.

The air pressure gauge can be provided in the handle of the ball with a passageway connecting the gauge to the interior of the ball. Also, however, if the ball is provided with a valve such as one used to accept an inflation needle as is customarily used to inflate footballs and basketballs, then a separate air pressure gauge attached to the needle via a hose can be used to read the air pressure in the exercise ball as an exercise is being performed. This gives the user immediate feedback and permits him to control the strenuousness of the exercise. This feedback is important for a graduated exercise program.

The needle can be used to bleed air from the device and to allow air to be pumped in it increase the pressure. Preferable, the device of this invention is supplied in kit form with a simple handpump e.g. one normally used with a blood pressure cuff and a pressure gauge with an attached hose.

This is a safe method of exercise since the only resistance produced against the patient is proportional to the amount of force that he provides, i.e. the patient is in control of the strenuousness of the exercise. If there is persistent inflammation or any ligamentous instability the patient will not push as hard and therefore will not re-injure himself. If he were utilizing free weights going through an isotonic type of exercise, injury could be easily sustained, e.g. with a harness and chain weight, the user cannot immediately stop if he feels pain, but must continue to hold the weights until they can be removed.

The term isokinetic refers to a change in resistance as the subject pushes through the range of motion. This means that if a patient pushes let us say 4 cm of water or 4 lbs. per square inch at the initial phase of flexion for 10 degrees and then decreases it to 3 lbs per square inch through the remaining 15 to 20 degrees of flexion, this is a change in the resistance. The patient will get as much resistance out of the unit equal to the effort he puts into it. As noted above, this is an added safety feature as well as an efficient way to exercise.

THE DRAWINGS

DESCRIPTION

Figure 1:
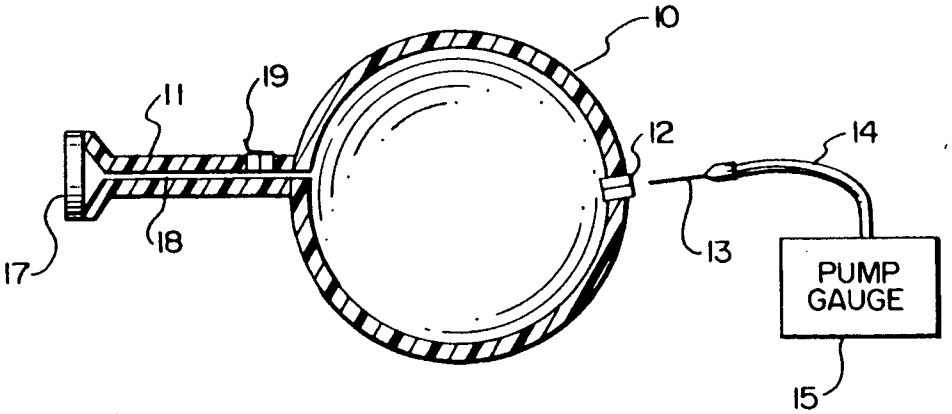
FIG. 1 is a cross-sectional view of the exercise device of this invention.

Referring to FIG. 1, a resilient ball 10 having a flexible skin is provided with a handle 11. The ball may be made out of any suitable rubber or elastomer which while flexible does not particularly stretch or extend under the conditions of use. A rotationally cast vinyl has been found to be satisfactory. The handle 11 can be made out of a similar material and adhesively secured or fused to the ball as illustrated. The ball usually will have a diameter over 6 inches and preferably has a diameter of 8 to 10 inches or it may be larger, say 12 inches or so.

The device has a valve means 12 for admitting or expelling air from the interior of the ball. As illustrated, this consists of a rubber plug designed to receive an air injection needle 13 which is connected via a line 14 to a pump and/or air pressure gauge 15.

Instead of using a gauge separate from the device to determine the internal pressure, a gauge 17 may be placed on the handle 11 and connected by passageway 18 to the interior of the ball. Handle 11 can also contain a valve means 19 for the admitting or expelling of air such that a need for a valve 12 in the skin of the ball is obviated.

Figure 2:
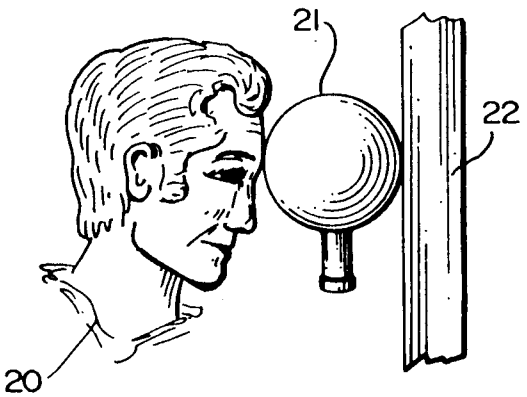
FIG. 2 illustrates how one uses the exercise device.

FIG. 2 illustrates how the exercising device of this invention is used. The person 20 undertaking the exercise places the device 21 of this invention against a wall and presses his head firmly against the device. He uses the handle to position the device and his hand may be removed when he commences the exercise. The exerciser then proceeds to exercise his neck muscles by moving his head up and down, from side to side, and/or with some rotation so that the neck muscles are exercised in all vectors of motion. He or someone else can read the pressure gauge at this time to make a determination of how much effort is being put into the exercise. This will permit a reproducable objective analysis of the strength, power and endurance of the neck muscles in all planes of motion. The device can be used, of course, for simple isometric exercises, i.e. where the user simply presses against the device with no motion.

Force-pressure characteristics were obtained experimentally by compressing the device of this invention with known forces ranging from 5 to 100 lbs. The sphere had a diameter of 8.5 inches. The relationship between the applied force was linear, as expected, for baseline (intial) internal pressures of 0, 20, 40, 60, 80 and 100 mmHg and applied forces ranging from 20 to 100 lbs. This established that the device can serve as a quantitative measure of neck muscle force and that equal gains in force produce equal gains in internal pressure, independent of starting pressure.

The firmness offered by the device can be adjusted by the admitting or release of air from the device via the pump and valve.

Figure 3:
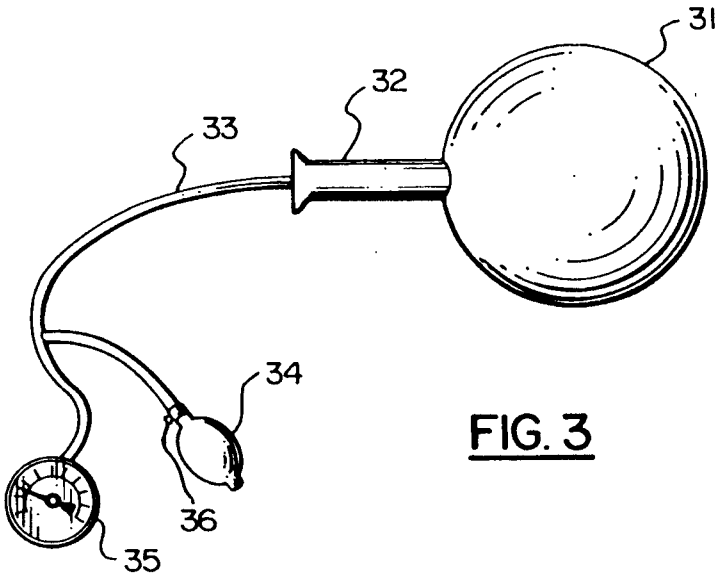
FIG. 3 illustrates a preferred embodiment.

FIG. 3 illustrates a preferred embodiment wherein a rotationally cast, flexible self inflating sphere 31 having an integral hollow handle 32 has attached at the end of the handle flexible tubing 33 that connects to a pressure gage 35 and a hand pump 34. This arrangement permits the user while holding the handle 32 with one hand to hold the pressure gage 35 with the other before his eyes so that he can see the pressure being generated by the force of his effort.

Hand pump 34 can be the same as used to inflate pressure cuffs for taking blood pressure and has a bleed valve 36.

As an example, a prescription for a whiplash injury could include:

a. acute stage: patient would perform light isometric type of resisted motion in all planes. Inflation of the exercise device would be high;

b. subacute to more chronic phase: patient performs in all the vectors of motion, 6 to 8 repetitions each, for a 3 count in both the positive and negative directions. He would perform the exercises twice per day with feedback through the use of a pressure gauge.

Prior to the exercise regime, the patient would be tested with the modality by the prescribing physician. At the end of his exercise regime he would be retested to check the progress.

It can be seen that this cervical dynamometer and exerciser provides variable isokinetic resistance in all directions of motion of the head. When used in a regular program the device of this invention permits of a more rapid healing of an injured cervical and tends to prevent future injury.

Preliminary tests on 8 men established that a 6 week to 2 month program of regular exercises produces marked increases in the forces generated by the neck muscles during flexion, extension, and lateral flexion. In addition, neck muscle imbalance during lateral flexion was markedly reduced.

In summary, the present exercise device and regimen is versatile permitting isotonic, isometric, and isokinetic types of exercise with a global range of motion–flexion, extension and circumduction. It is safe and efficient allowing visual feedback for controlling resistance preventing muscle over-load and permitting training with proven techniques. It has diagnostic capability in that it can detect muscle imbalance and can quantify progress. The device also preferable includes a means permitting the observing and adjusting of the internal pressure of the ball and thus of the hardness or resistance offered by the ball.

What is claimed is:

1. A method of exercising muscles of the cervical spine comprising:

providing an inflated hollow airtight resilient sphere free of liquid and having a flexible skin with hand grip means attached thereto, and pressure observing means for observing the pressure in said sphere, said sphere being inflated to at least 2 pounds per square inch pressure;

placing said sphere against a substantially vertical surface with one hand holding said hand grip means;

placing one's head against said sphere and pressing said sphere against said surface; and while continuing to so press the head against said sphere exercising selected muscles of the cervical spine by rotating the head in all directions of motion.

2. The method of claim 1 comprising the additional step of observing in a planned regime of exercise the pressure generated by the pressing of the head against said spheres and over a graduated series of exercise periods increasing the pressure generated by the pressing.

3. The method of claim 2 comprising the additional step of changing over a series of exercise periods the resistance offered by said sphere by adding or removing gas from said sphere.

4. The method of claim 2 comprising the additional steps of observing said pressure while rotating the head in all planes of motion and assessing the relative strength, power and endurance of the neck muscles.

5. A method of quantifying cervical muscle strength or detecting muscle imbalance comprising:

providing an inflated hollow airtight resilient sphere free of liquid and having a flexible skin with hand grip means attached thereto, and pressure observing means for observing the pressure in said sphere, said sphere being at least 8 inches in diameter and being inflated to at least 2 pounds per square inch pressure;

having a subject place said sphere against a substantially vertical surface with his hand holding said hand grip means with his head against said sphere pressing said sphere against said surface; and while the subject continues to so press his head against said sphere having the subject rotate his head in flexion, extension and circumduction, while observing for each muscle group the pressure generated with said pressure observing means.

6. A neck muscle dynamometer and exerciser to be used by pressing said dynamometer and exerciser with the head against a wall, said dynamometer and exerciser providing controlled isokinetic resistance in all directions of motion of the head, comprising:

an inflated hollow airtight ball free of liquid and having a flexible skin of an elastomer essentially nonextensible under the conditions of use;

a cylindrical handle attached to said flexible skin with the axis of said cylindrical handle aligned with a radius of said ball;

a hand pump and valve means for increasing or decreasing the pressure in said ball;

a pressure gauge for observing said pressure; and a length of hose communicating at one end through said cylindrical handle with the interior of said ball and at the other end with said hand pump and valve means and said pressure gauge, said hose having a length sufficient to permit said pressure gauge to be held in front of the eyes of the person using the said dynamometer and exerciser while in use.

7. The dynamometer and exerciser of claim 6 wherein said ball has a diameter in the range of 8 to 12 inches.

* * * * *